US006712226B1

(12) United States Patent
Williams, Jr.

(10) Patent No.: US 6,712,226 B1
(45) Date of Patent: Mar. 30, 2004

(54) WALL OR CEILING MOUNTABLE BRACKETS FOR STORING AND DISPLAYING BOARD-BASED RECREATIONAL EQUIPMENT

(76) Inventor: James E. Williams, Jr., P.O. Box 7636, Jackson, WY (US) 83002

( * ) Notice: Subject to any disclaimer, the term of this patent is extended or adjusted under 35 U.S.C. 154(b) by 0 days.

(21) Appl. No.: 10/188,650

(22) Filed: Jul. 1, 2002

Related U.S. Application Data

(63) Continuation-in-part of application No. 09/805,080, filed on Mar. 13, 2001, now abandoned.

(51) Int. Cl.[7] ..... A47G 29/02

(52) U.S. Cl. ..... 211/85.7; 211/70.5; 248/201; 248/235

(58) Field of Search ..... 211/70.5, 85.7; 248/301, 235, 201, 304; D6/513, 512, 524, 546, 549, 550, 552, 553

(56) References Cited

U.S. PATENT DOCUMENTS

| | | | | | |
|---|---|---|---|---|---|
| 3,360,075 | A | | 12/1967 | Gutner | 182/106 |
| 3,421,725 | A | | 1/1969 | Glass | 248/304 |
| 3,511,384 | A | | 5/1970 | Pratt | 211/60 |
| 4,124,093 | A | * | 11/1978 | Breisch | 182/186.5 |
| 4,162,013 | A | * | 7/1979 | Tucker | 211/43 |
| 4,419,872 | A | | 12/1983 | Plifka | 70/18 |
| 4,473,225 | A | | 9/1984 | Miller | 272/62 |
| D313,522 | S | * | 1/1991 | Bingham | D6/547 |
| 4,988,007 | A | | 1/1991 | Chiarot | 211/70.5 |
| 5,013,066 | A | | 5/1991 | Adkins | 280/809 |
| 5,078,279 | A | | 1/1992 | Hancock et al. | 211/64 |
| D384,576 | S | | 10/1997 | Holder | D8/373 |
| 5,685,516 | A | | 11/1997 | Simmons | 248/489 |
| D393,961 | S | * | 5/1998 | Whitehead et al. | D6/464 |
| 5,799,915 | A | | 9/1998 | Morey | 248/201 |
| 5,826,908 | A | | 10/1998 | McBride | 280/814 |
| 5,934,488 | A | | 8/1999 | Grimshaw | 211/70.5 |
| 5,957,819 | A | | 9/1999 | Cortesi | 482/121 |
| 5,992,813 | A | | 11/1999 | Keers | 248/489 |
| 6,196,397 | B1 | | 3/2001 | Maher | 211/85.7 |
| 6,561,364 | B1 | * | 5/2003 | Brunsden | 211/90.01 |

OTHER PUBLICATIONS

Bakoda Board Hangers, 1 Sheet, Copy of Web Page.
Burton Twister Rack, 1 Sheet, Copy of Web Page.
Tredicino Wall–Mounted Ski Holder, 1 Sheet, Copy of Web Pg.
Mohn Snowboard Floor Rack, 1 Sheet, Copy of Web Page.

* cited by examiner

*Primary Examiner*—Daniel P. Stodola
*Assistant Examiner*—Erica B Harris
(74) *Attorney, Agent, or Firm*—Flanagan & Flanagan; John R. Flanagan

(57) ABSTRACT

A wall or ceiling mountable bracket, used in pairs, for storing and displaying board-based recreational equipment includes a generally U-shaped body having structurally-reinforced elongated front and rear portions and a spacer portion extending between and rigidly interconnecting them so as to hold them in a spaced apart relationship which forms an elongated channel between them being open at one end and along opposite sides and closed at an opposite end for receiving board-based recreational equipment in the channel. The bracket also includes structures providing access through the body to facilitate fastening the body with its rear portion located against a support structure. The access providing structures define at least two bores, one through the rear portion and the other through the spacer portion and through segments of the front and rear portions aligned with and connected to the spacer portion.

17 Claims, 3 Drawing Sheets

WALL OR CEILING MOUNTABLE BRACKETS FOR STORING AND DISPLAYING BOARD-BASED RECREATIONAL EQUIPMENT

This application is a continuation-in-part of application Ser. No. 09/805,080 filed Mar. 13, 2001, now abandoned.

BACKGROUND OF THE INVENTION

1. Field of the Invention

The present invention generally relates to a device for mounting and storing recreational equipment on walls and, more particularly, is concerned with wall or ceiling mountable brackets for storing and displaying board-based recreational equipment, such as snowboards and skis.

2. Description of the Prior Art

Board-based recreational equipment, such as snowboards and skis, are stored by owners during periods of nonuse in a variety of different ways. Some owners merely lean the equipment up against a wall or at a corner of a room or lie the equipment on the floor along a wall. Others place the equipment in large bags especially designed to accommodate snowboards and skis and then store the bagged equipment in an attic, basement, crawlspace or garage. Still others have attached various mechanical devices to a wall for standing snowboards and skis either upright or horizontally along the wall. Frequently, the storage of board-based recreational equipment in a substandard manner or inadequate location leads to damage, such as scratches, dents or cracks, to equipment and injury to persons when such equipment is bumped and falls down.

It is widely appreciated by recreational equipment manufacturers that substantially all owners of board-based recreational equipment, such as snowboards and skis, gain enormous pleasure from riding their equipment during use on the slopes. It is not so widely appreciated by such equipment manufacturers that many owners also derive much satisfaction during periods of nonuse by just admiring their equipment either while alone or with their friends. The aforementioned different ways and mechanical devices that are used to store board-based recreational equipment during offseason or periods of nonuse during season do not cater to equipment owners being able to readily store and, at the same time, display their equipment in a protected manner so that they, along with their friends, can gain further enjoyment of their board-based equipment during nonuse.

Consequently, a need exists for a device which will allow readily accessible and protected storage and display of board-based recreational equipment during periods of nonuse of the equipment.

SUMMARY OF THE INVENTION

The present invention provides wall or ceiling mountable brackets for storing and displaying board-based recreational equipment, such as snowboards and skis, which brackets are designed to satisfy the aforementioned need. The brackets of the present invention provide a proper means for storing and displaying board-based recreational equipment, such as a snowboard, skis, a skateboard or a surfboard, either on a wall or a ceiling so that they can be enjoyed year around while still being positioned out of the way. Boarders receive the satisfaction of displaying their individualistic artsmanship and having their sticker-laden boards properly displayed and protected for all to see.

Accordingly, the present invention is directed to a mountable bracket for storing and displaying board-based recreational equipment wherein the bracket comprises: (a) a generally U-shaped body having an elongated front portion, an elongated rear portion and a spacer portion extending between and rigidly interconnecting the front and rear portions so as to hold the front and rear portions in a spaced apart relationship which forms an elongated channel therebetween being open at one end and along opposite sides and closed at an opposite end for receiving board-based recreational equipment in the channel between the front and rear portions and adjacent to the spacer portion; and (b) means on the body for providing access through the body to facilitate fastening the body to a support structure with the rear portion thereof located against the support structure, the access providing means being defined at least through the rear portion and through the spacer portion and segments of the front and rear portions aligned with and connected to the spacer portion.

The present invention also is directed to a mountable bracket for storing and displaying board-based recreational equipment wherein the bracket comprises: (a) a generally U-shaped body having an elongated front portion, an elongated rear portion and a spacer portion extending between and rigidly interconnecting the front and rear portions so as to hold the front and rear portions in a spaced apart relationship which forms an elongated channel therebetween being open at one end and along opposite sides and closed at an opposite end for receiving board-based recreational equipment in the channel between the front and rear portions and adjacent to the spacer portion, each of the front and rear portions having a pair of recesses formed therein which extend longitudinally between opposite ends of the front and rear portions and open at opposite longitudinal sides of the front and rear portions, each of the front and rear portions further having bracing structures disposed in the recesses for strengthening the front and rear portions; and (b) means on the body for providing access through the body to facilitate fastening the body to a support structure with the rear portion thereof located against the support structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
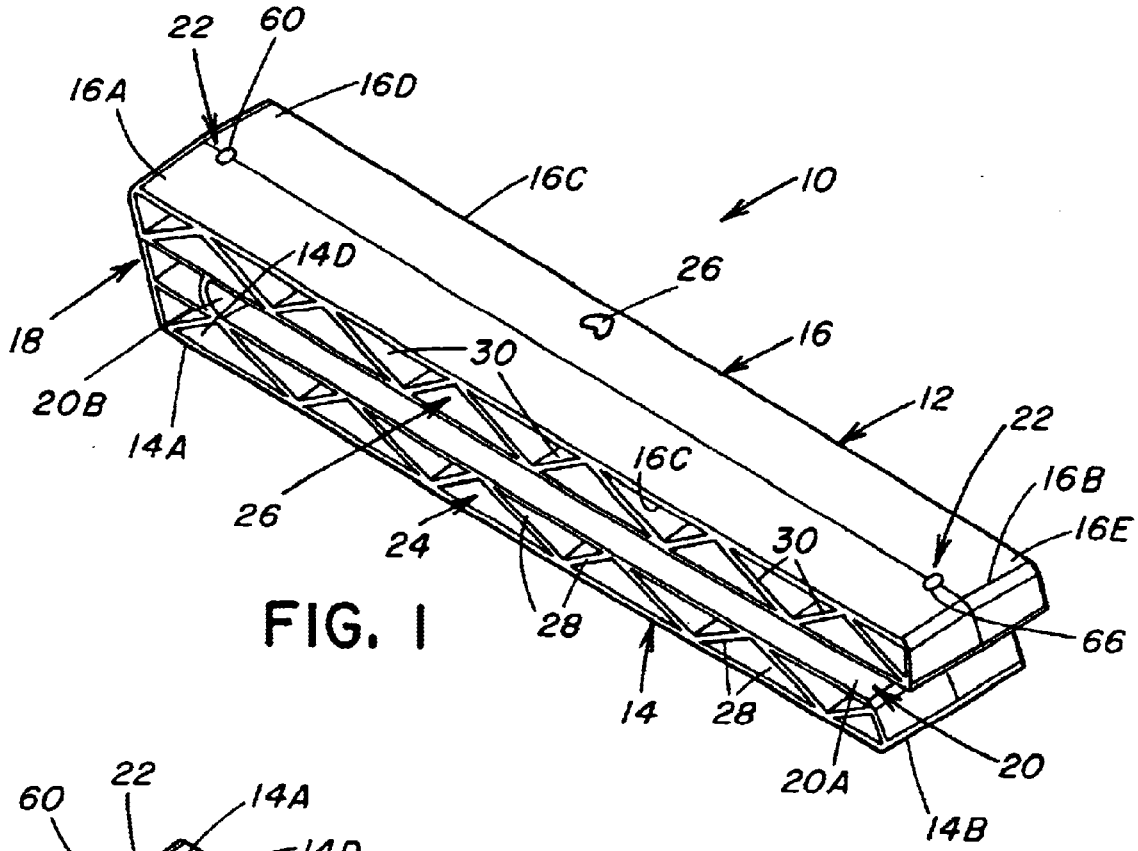
FIG. 1 is a back perspective view of a bracket of the present invention.
Figure 2:
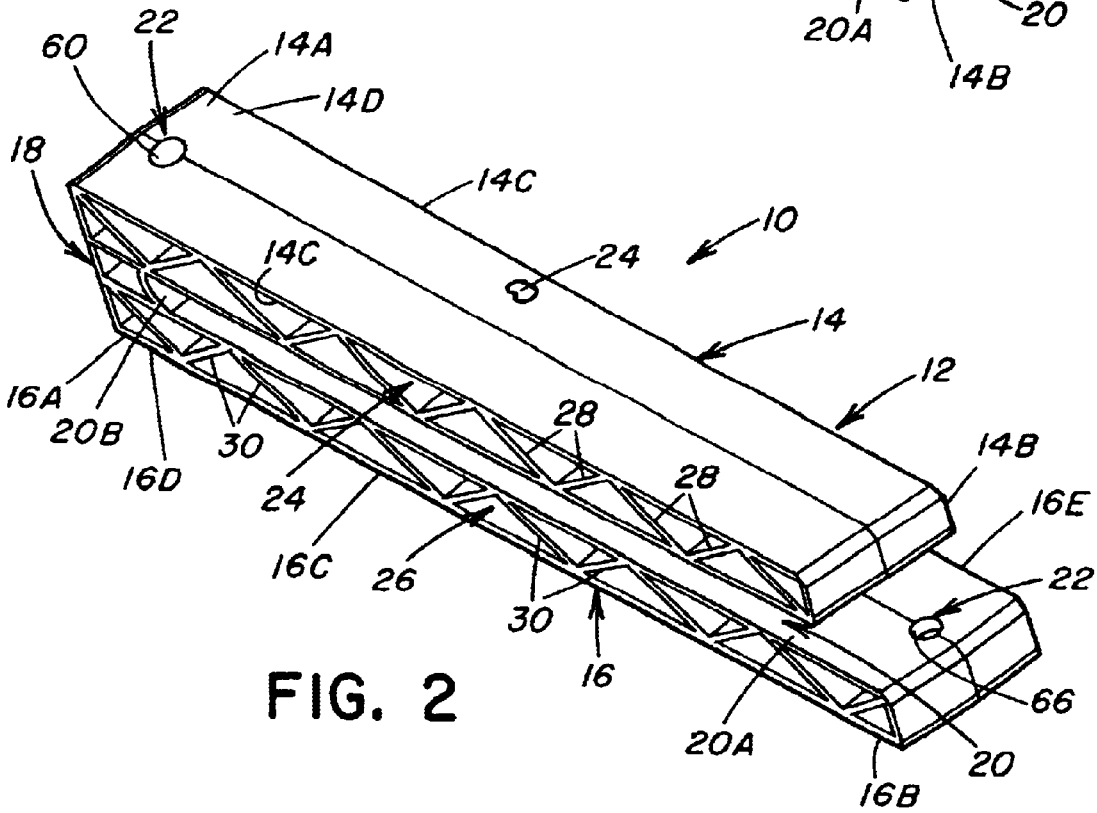
FIG. 2 is a front perspective view of the bracket of FIG. 1.
Figure 6:
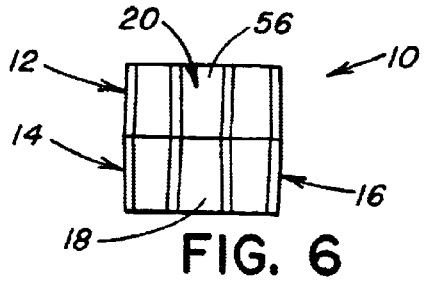
FIG. 6 is an end elevational view of the bracket as seen along line 6—6 of FIG. 3.
Figure 4:
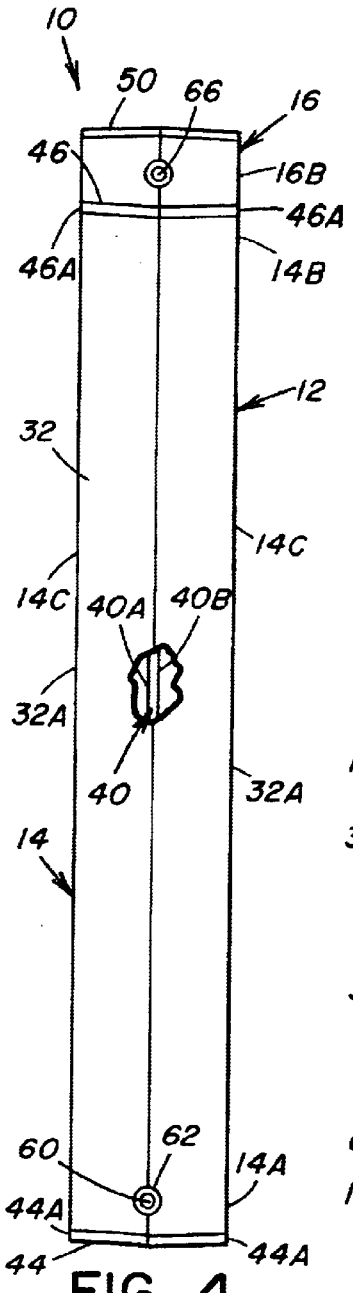
FIG. 4 is a front elevational view of the bracket as seen along line 4—4 of FIG. 3.
Figure 3:
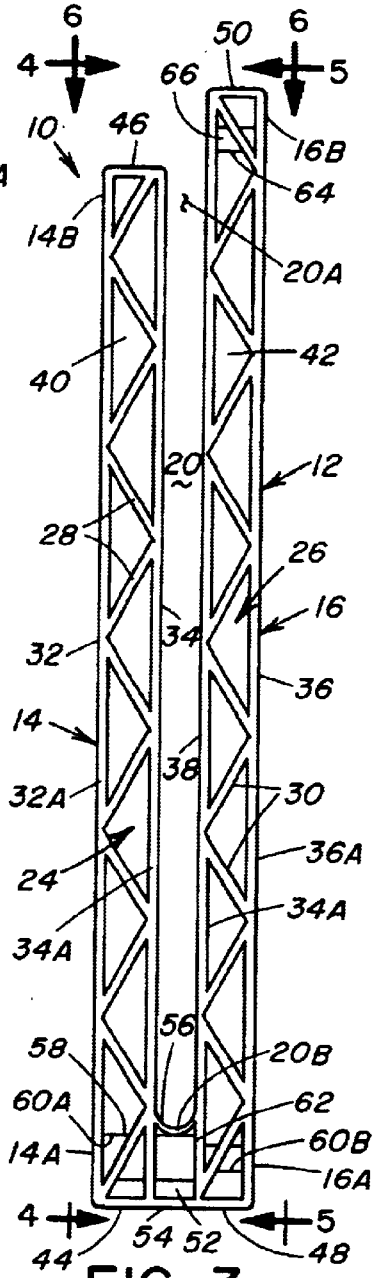
FIG. 3 is an enlarged side elevational view of the bracket.
Figure 5:
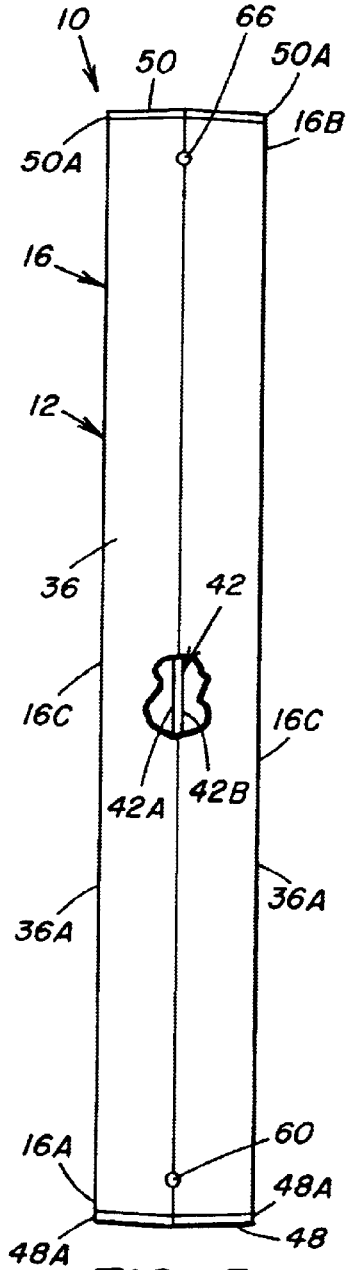
FIG. 5 is a rear elevational view of the bracket as seen along line 5—5 of FIG. 3.

Referring to the drawings and particularly to FIGS. 1 and 2, there is illustrated one of a plurality, preferably a pair, of wall or ceiling mountable brackets, generally designated 10, of the present invention. In an exemplary application, the brackets 10 are useful in storing and displaying board-based recreational equipment, such as a snowboard B as seen in FIGS. 7 and 8.

Each bracket 10 basically includes a generally U-shaped body 12 having an elongated front portion 14, an elongated rear portion 16 and a bight, intermediate or spacer portion 18 extending between and rigidly interconnecting the front and rear portions 14, 16. The rigid interconnection between first ends 14A, 16A of the front and rear portions 14, 16 provided by the spacer portion 18 holds the front and rear portions 14, 16 in a fixed spaced apart relationship with one another so as to form an elongated channel 20 between the front and rear portions 14, 16. The channel 20 is open at one end 20A located between opposite second ends 14B, 16B of the front and rear portions 14, 16, open along and adjacent to opposite sides 14C, 16C of the front and rear portions 14, 16, and is closed at an opposite end 20B by the spacer portion 18 which integrally interconnects the first ends 14A, 16A of the front and rear portions 14, 16.

Figure 7:
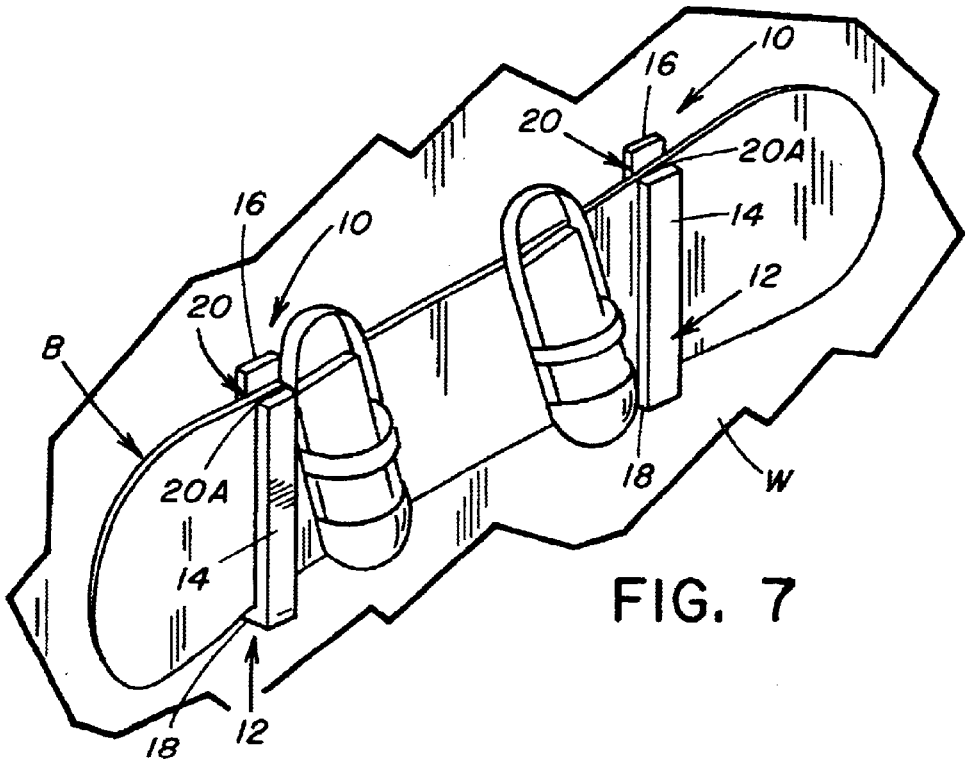
FIG. 7 is a perspective view of a pair of the brackets mounted on a wall and storing a snowboard.

As seen in FIG. 7, the snowboard B can be received in the channel 20 between the front and rear portions 14, 16 through the open one end 20A and rest upon and above the spacer portion 18 when each bracket 10 is mounted on a wall W. As also seen in FIG. 8, the snowboard B can be received in the channel 20 and rest upon the front portion 14 when each bracket 10 is mounted on a ceiling C.

Figure 8:
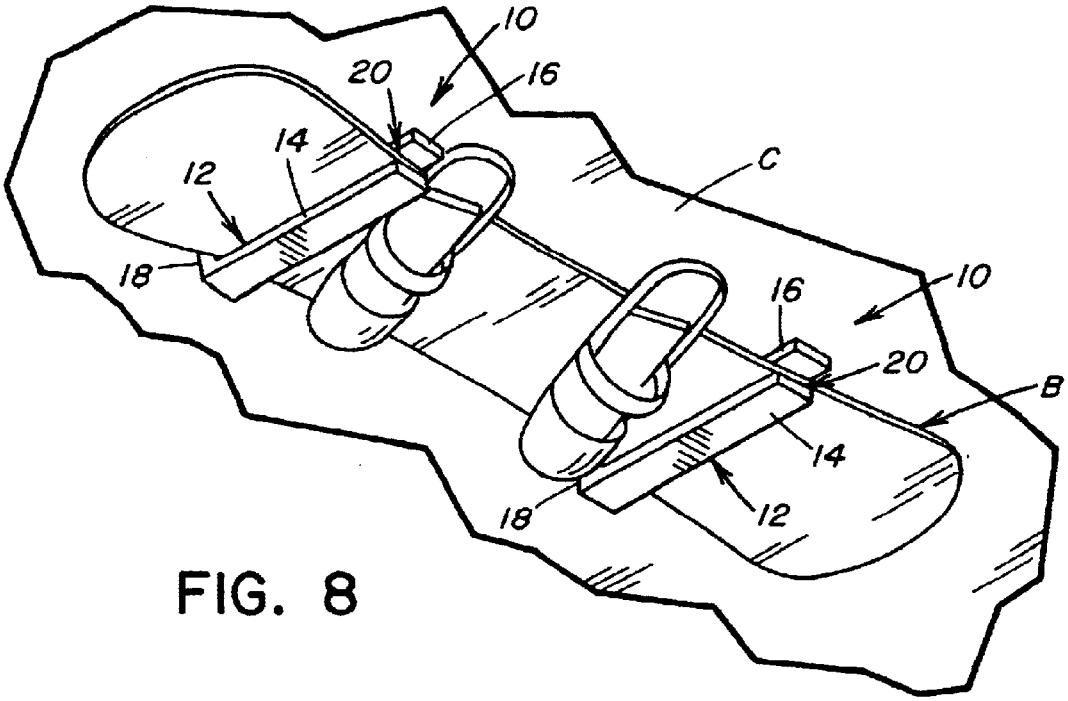
FIG. 8 is a perspective view of a pair of the brackets mounted on a ceiling and storing a snowboard.

Each bracket 10 further includes means 22 on the body 12 for providing access through the body 12 to facilitate fastening the body 12 to a support structure, such as the wall W as seen in FIG. 7 or the ceiling C as seen in FIG. 8, with the rear portion 16 of the body 12 located against the wall W or ceiling C. Conventional fasteners (not shown), such as two-inch sheetrock screws, can be used to fasten the brackets 10 to the wall W or ceiling C.

Referring to FIGS. 1 to 6, each of the front and rear portions 14, 16 of the body 12 has a pair of recesses 24, 26 formed therein which extend longitudinally between the opposite first and second ends 14A, 14B and 16A, 16B of the front and rear portions 14, 16 and open at the opposite longitudinal sides 14C, 16C of the front and rear portions 14, 16. Each of the front and rear portions 14, 16 of the body 12 further has a pair of bracing structures 28, 30 disposed in the corresponding recesses 24, 26 for reinforcing and thus strengthening the front and rear portions 14, 16.

More particularly, each of the front and rear portions 14, 16 of the body 12 includes outer and inner walls 32, 34 and 36, 38 which each has longitudinally-extending opposite side edges 32A, 34A and 36A, 38A, an intermediate wall 40 and 42 having opposite sides 40A, 40B, 42A and 42B and being disposed between and spacing apart the outer and inner walls 32, 34 and 36, 38, and end walls 44, 46 and 48, 50. The end walls 44, 46 and 48, 50 rigidly interconnect the outer and inner walls 32, 34 and 36, 38. The intermediate walls 40 and 42 are rigidly connected with and extend in a transverse relationship to the outer and inner walls 32, 34 and 36, 38 and end walls 44, 46 and 48, 50 at intermediate locations that extend between opposite ends 14A, 14B and 16A, 16B of the front and rear portions 14, 16 and are spaced from the opposite side edges 32A, 34A and 36A, 38A of the outer and inner walls 32, 34 and 36, 38 and from opposite side edges 44A, 46A and 48A, 50A of the end walls 44, 46 and 48, 50. The pairs of recesses 24, 26 in the front and rear portions 14, 16 of the body 12 are defined between the outer and inner walls 32, 34 and 36, 38 and end walls 44, 46 and 48, 50 thereof at the opposite sides 40A and 42A of the intermediate walls 40 and 42 thereof.

The bracing structures 28, 30 of the bracket 10 disposed in the corresponding recesses 24, 26 of the front and rear portions 14, 16 of the body 12 extend along the respective opposite sides 40A, 40B, 42A and 42B of the intermediate walls 40, 42 of the front and rear portions 14, 16 and between the outer and inner walls 32, 34 and 36, 38 and end walls 44, 46 and 48, 50 thereof. Further, the bracing structures 28, 30 are rigidly attached to the outer, inner, intermediate and end walls 32, 34, 40, 44, 46 and 36, 38, 42, 48, 50 of the front and rear portions 14, 16. Each bracing structure 28, 30 has an undulating configuration such that the given bracing structure 28, 30 is rigidly attached to the outer and inner walls 32, 34 and 36, 38 of the front and rear portions 14, 16 at locations spaced apart longitudinally along the outer and inner walls 32, 34 and 36, 38.

Also, the spacer portion 18 of the body 12 has an intermediate wall 52 extending between and rigidly connected with the inner walls 34, 38 of the front and rear portions 14, 16 of the body 12 and opposite end walls 54, 56 extending between and rigidly connected with the end walls 44, 48 of the front and rear portions 14, 16 and inner walls 34, 38 of the front and rear portions 14, 16. The intermediate wall 52 of the spacer portion 18 of the body 12 is aligned with the intermediate walls 40, 42 of the front and rear portions 14, 16 of the body 12.

The access providing means 22 includes a first structure 58 having an annular shape which is formed through the spacer portion 18 and segments 14D, 16D of the front and rear portions 14, 16 adjacent the first ends 14A, 16A thereof. The segments 14D, 16D of the front and rear portions 14, 16 are aligned with and rigidly connected to the spacer portion 18 of the body 12. The first structure 58 defines a first bore 60 which is adapted to receive a fastener therethrough. The first bore 60 extends transversely to and through the segments 14D, 16D of the front and rear portions 14, 16 and through the spacer portion 18 of the body 12. More specifically, the first structure 58 is integrally connected with the outer and inner walls 32, 34 and 36, 38 of the front and rear portions 14, 16 and with the intermediate walls 40, 42, 52 of the front, rear and spacer portions 14, 16, 18 of the body 12 and by being so formed augments the strength of the bracket 10 in this region thereof. The first bore 60 preferably has first and second portions 60A, 60B of different diameters so as to form an annular shoulder 62 therein against which the head of a fastener, such as a screw, will abut in order to tighten and thereby fasten the body 12 against the support structure.

The access providing means 22 also includes a second structure 64 having an annular shape which is formed through another segment 16E of the rear portion 16 of the body 12 adjacent the second end 16B thereof. The segment 16E of the rear portion 16 of the body 12 extends beyond the second end 14B of the front portion 14 of the body 12 and beyond the open one end 20A of the channel 20. The second structure 64 defines a second bore 66 adapted to receive a fastener therethrough. The second bore 66 extends through the segment 16E of the rear portion 16 of the body 12 and is spaced from the first bore 62. More specifically, the second structure 64 is integrally connected with the outer, inner and intermediate wall 36, 38, 42 of the rear portion 16 of the body 12.

The brackets 10 can be of any desired size, made of any suitable conventional material, such as wood, plastic or metal, and made by using any suitable conventional manufacturing techniques, such as by injection molding in the case of plastic material. For the sake of simplicity, the brackets 10 are shown in FIGS. 7 and 8 without the recesses and bracing structures. When each bracket 10 is mounted vertically on the wall W, the brackets 10 are preferably placed generally parallel to one another and spaced horizontally from one another, as seen in FIG. 7, and the open end 20A of the channel 20 of each bracket 10 is preferably spaced vertically above the closed end 20B of the channel 20. When each bracket 10 is mounted horizontally on the ceiling C, the brackets 10 are preferably placed generally parallel to one another and spaced horizontally from one another, as seen in FIG. 8. Because the width of the channel 20 can be just slightly larger than the thickness of the snowboard B, there is little, if any, possibility that the snowboard B will become dislodged from the channel 20 by itself and without being bumped by someone. The long narrow configuration of the body 12 of each bracket 10 ensures that only a minimal amount of area of the surface of the snowboard B is covered, as can be seen in FIGS. 7 and 8. It should be noted that the snowboard B can be installed into the brackets 10 by using only one hand, if desired, and that there are no moving parts on the brackets 10 which have to be manipulated when either installing or removing the snowboard B into or from the brackets 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A mountable bracket for storing and displaying board-based recreational equipment, said bracket comprising:

(a) a generally U-shaped body having an elongated front portion, an elongated rear portion and a spacer portion extending between and aligned with and rigidly interconnecting segments of said front and rear portions so as to hold said front and rear portions in a spaced apart relationship which forms an elongated channel therebetween being open at one end and along opposite sides and closed at an opposite end for receiving board-based recreational equipment in said channel between said front and rear portions and adjacent to said spacer portion, each of said front and rear portions having a pair of recesses formed therein which extend longitudinally between opposite ends of said front and rear portions and open at opposite longitudinal sides of said front and rear portions, each of said front and rear portions further having bracing structures disposed in said recesses for strengthening said front and rear portions; and (b) means on said body for providing access through said body to facilitate fastening said body to a support structure with said rear portion thereof located against the support structure;

(c) each of said front and rear portions of said body including (i) outer and inner walls each having longitudinally-extending opposite side edges, and (ii) an intermediate wall having opposite sides and being disposed between and spacing apart said outer and inner walls and rigidly connected and extending in a transverse relationship to said outer and inner walls at intermediate locations that extend between opposite ends of said outer and inner walls and are spaced from said opposite side edges of said outer and inner walls, said pairs of recesses in said front and rear portions of said body being defined between said outer and inner walls thereof at said opposite sides of said intermediate walls thereof.

2. The bracket of claim 1 wherein said means for providing access includes a first structure defining a first bore extending transversely to and through said segments of said front and rear portions of said body and through said spacer portion of said body, said first bore being adapted to receive a fastener therethrough.

3. The bracket of claim 2 wherein said first bore has first and second portions of different diameters.

4. The bracket of claim 2 wherein said means for providing access includes a second structure defining a second bore extending through another segment of said rear portion of said body and being spaced from said first bore, said second bore being adapted to receive a fastener therethrough.

5. The bracket of claim 4 wherein said another segment of said rear portion of said body extends beyond said front portion of said body at said open one end of said channel defined therebetween.

6. The bracket of claim 1 wherein said space portion of said body has an intermediate wall extending between and rigidly connected with said inner walls of said segments of said front and rear portions of said body.

7. The bracket of claim 6 wherein said intermediate wall of said spacer portion of said body is aligned with said intermediate walls of said front and rear portions of said body.

8. The bracket of claim 1 wherein said bracing structures disposed in said recesses extend along said opposite sides of said intermediate walls of said front and rear portions and between said outer and inner walls thereof and are rigidly attached to said outer, inner and intermediate walls thereof.

9. The bracket of claim 8 wherein each of said bracing structures has an undulating configuration such that said each bracing structure is rigidly attached to said outer and inner walls of said front and rear portions at locations spaced apart longitudinally along said outer and inner walls.

10. A mountable bracket for storing and displaying board-based recreational equipment, said bracket comprising:

(a) a generally U-shaped body having an elongated front portion, an elongated rear portion and a spacer portion extending between and rigidly interconnecting said front and rear portions so as to hold said front and rear portions in a spaced apart relationship which forms an elongated channel therebetween being open at one end and along opposite sides and closed at an opposite end for receiving board-based recreational equipment in said channel between said front and rear portions and adjacent to said spacer portion, each of said front and rear portions having a pair of recesses formed therein which extend longitudinally between opposite ends of said front and rear portions and open at opposite longitudinal sides of said front and rear portions, each of said front and rear portions further having bracing structures disposed in said recesses for strengthening said front and rear portions; and (b) means on said body for providing access through said body to facilitate fastening said body to a support structure with said rear portion thereof located against the support structure, said access providing means being defined at least through said rear portion and through said spacer portion and segments of said front and rear portions aligned and connected to said spacer portion;

(c) each of said front and rear portions of said body including (i) outer and inner walls each having longitudinally-extending opposite side edges, and (ii) an intermediate wall having opposite sides and being disposed between and spacing apart said outer and inner walls and rigidly connected and extending in a transverse relationship to said outer and inner walls at intermediate locations that extend between opposite ends of said outer and inner walls and are spaced from said opposite side edges of said outer and inner walls, said pairs of recesses in said front and rear portions of said body being defined between said outer and inner walls thereof at said opposite sides of said intermediate walls thereof.

11. The bracket of claim 10 wherein said bracing structures disposed in said recesses extend along said respective opposite sides of said intermediate walls of said front and rear portions and between said outer and inner walls thereof and are rigidly attached to said outer, inner and intermediate walls thereof.

12. The bracket of claim 11 wherein each of said bracing structures has an undulating configuration such that said each bracing structure is rigidly attached to said outer and inner walls of said front and rear portions at locations spaced apart longitudinally along said outer and inner walls.

13. The bracket of claim 10 wherein said spacer portion of said body has an intermediate wall extending between and rigidly connected with said inner walls of said segments of said front and rear portions of said body, said intermediate wall of said spacer portion of said body being aligned with said intermediate walls of said front and rear portions of said body.

14. The bracket of claim 13 wherein said means for providing access includes a first structure defining a first bore adapted to receive a fastener therethrough and extending transversely to and through said segments of said front and rear portions of said body and through said spacer portion of said body, said first structure being integrally connected with said outer and inner walls of said front and rear portions and said intermediate walls of said front, rear and spacer portions of said body.

15. The bracket of claim 14 wherein said first bore as first and second portions of different diameters.

16. The bracket of claim 14 wherein said means for providing access includes a second structure defining a second bore adapted to receive a fastener therethrough and extending through another segment of said rear portion of said body and being spaced from said first bore, said second structure being integrally connected with said outer, inner and intermediate walls of said rear portion of said body.

17. The bracket of claim 16 wherein said another segment of said rear portion of said body extends beyond said front portion of said body at said open one end of said channel defined therebetween.

* * * * *